US005521624A

United States Patent [19]

Matsuda et al.

[11] Patent Number: 5,521,624

[45] Date of Patent: May 28, 1996

[54] THIN TYPE OF INK JET CARTRIDGE

[75] Inventors: Mitsuhide Matsuda, Fukuoka-ken; Yutaka Miyazono, Kasuga; Kazumi Ohtsubo, Kurume; Hideaki Horio; Takumi Inoue, both of Fukuoka, all of Japan

[73] Assignee: Matsushita Electric Industrial Co., Ltd., Osaka, Japan

[21] Appl. No.: 955,981

[22] Filed: Oct. 2, 1992

[30] Foreign Application Priority Data

| | | | |
|---|---|---|---|
| Oct. 24, 1991 | [JP] | Japan | 3-277425 |
| Nov. 25, 1991 | [JP] | Japan | 3-308803 |
| Dec. 26, 1991 | [JP] | Japan | 3-344308 |

[51] Int. Cl.[6] ..... B41J 2/175

[52] U.S. Cl. ..... 347/87; 220/501; 220/553

[58] Field of Search ..... 346/1.1, 75, 140 R; 206/444; 220/500, 501, 553, 554, 555; 347/86, 87, 44

[56] References Cited

U.S. PATENT DOCUMENTS

| | | | |
|---|---|---|---|
| 4,646,111 | 2/1987 | Shimosato et al. | 347/44 |
| 5,047,790 | 9/1991 | Cowger et al. | 347/87 |
| 5,182,581 | 1/1993 | Kashimura et al. | 347/87 |

FOREIGN PATENT DOCUMENTS

| | | | |
|---|---|---|---|
| 0486309 | 5/1992 | European Pat. Off. | 347/87 |
| 55-126461 | 9/1980 | Japan | 347/87 |
| 63-87242 | 4/1988 | Japan . | |
| 63-115756 | 5/1988 | Japan | 347/87 |

*Primary Examiner*—Benjamin R. Fuller
*Assistant Examiner*—John E. Barlow, Jr.
*Attorney, Agent, or Firm*—Pollock, Vande Sande & Priddy

[57] ABSTRACT

A thin type ink jet cartridge consists of a passageway for holding ink, a thin type ink holder made of transparent material for accommodating the passageway, a graded scale put on the thin type of ink holder to quantitatively check the volume of the ink held in the passageway, ribs for structurally reinforcing the thin type ink holder, nozzles for discharging the ink held in the passageway at a recording paper, a shutter for covering the shutter when the ink is not discharged from the nozzles, a protecting plate for protecting the recording paper from contact with the nozzles by surrounding the nozzles positioned at a concave portion surrounded by the protecting plate.

4 Claims, 11 Drawing Sheets

THIN TYPE OF INK JET CARTRIDGE

BACKGROUND OF THE INVENTION

1. Field of the Invention

The present invention relates to an ink jet cartridge which is charged with ink and is set in an ink jet printer to discharge drops of ink at a medium of record such as a recording paper, and, in particular, to a thin type ink jet cartridge in which the structure is reinforced and the ink is effectively utilized.

2. Description of the Related Art

Recently, ink jet printers have been utilized to record information on recording paper because such printer can operate at a low noise and at a high speed. In addition, because of downsizing of desk top type of computers to lap top type or notebook size type of computers to a small size is required. An ink jet cartridge put in the ink jet printer has been rapidly utilized because the cartridge can be easily exchanged for another and a small-sized ink jet cartridge can be easily provided at a low price.

2.1. Previously Proposed Art

A conventional ink jet cartridge is described with reference to FIGS. 1 to 4.

FIG. 1 is a disassembled diagonal view of a conventional ink jet cartridge.

As shown in FIG. 1, a conventional ink jet cartridge 11 is provided with a box type of ink packing portion 12 formed by a porous material in which ink 13 is packed, a box type of body 14 in which the ink packing portion 12 is accommodated, an ink cover 15 for holding the ink packing portion 12 in the body 14, and an ink discharging head 16 through which the ink 13 is discharged from the ink packing portion 12 to a recording paper.

The ink packing portion 12 is provided with an ink filter 17 for filtering dirt and bubbles in the ink 13 when the ink 13 is supplied to the ink discharging head 16 according to the capillary phenomenon.

The body 14 is provided with an ink supplying hole 18 through which the ink 13 packed in the ink packing portion 12 is supplied to the ink discharging head 16.

The ink discharging head 16 is provided with ink discharging nozzles 19 for discharging the ink 13 supplied from the ink packing portion 12 and an electric energy control portion 20 for controlling the discharge of the ink 13 by applying electric energy to respective heaters (not shown) which boil the ink 13 supplied to the corresponding nozzles 19. That is, the ink 13 boiled in the nozzles 19 is discharged to a recording paper because the ink 13 is rapidly expanded. In this case, because the size of the nozzles 19 is small, a drop of ink is discharged from each of the nozzles 19.

FIG. 2A is a plan view showing a drop of ink discharged at a recording paper from the cartridge shown in FIG. 1, and FIG. 2B is a side sectional view showing a drop of ink discharged at a recording paper from the cartridge shown in FIG. 1.

As shown in FIGS. 2A and 2B, drops of ink 21 are discharged from the conventional ink jet cartridge 11 at a line of a recording paper 22. The recording paper 22 is sent out by a column-shaped platen 23 to receive the drops of ink 21 at a following line of the recording paper 22. In addition, the recording paper 22 is held on the platen 23 by a holding plate 24 to correctly send out the recording paper 22. The conventional ink jet cartridge 11 is put in an ink jet printer (not shown) and is received to be movable in an axis direction along the platen 23 to print out letters on lines of the recording paper 22.

In the above configuration of the conventional ink jet cartridge 11, the ink 13 packed in the ink packing portion 12 is supplied to the ink discharging head 16 through the ink supplying hole 18 according to the capillary phenomenon. Therefore, the ink 13 is filled up in all of the ink discharging nozzles 19 of the ink discharging head 16. In this case, dirt and bubbles contained in the ink 13 are filtered off when the ink 13 passes through the ink filter 17.

Thereafter, when a discharging signal is transmitted to the electric energy control portion 20 to print out a prescribed letter on the recording paper 22, electric energy is applied to heaters corresponding to the nozzles 19 selected by the discharging signal. Therefore, the ink 13 supplied to the selected nozzles 19 is boiled because the ink 13 is heated by the energized heaters. That is, a portion of ink 13 in the selected nozzles 19 is vaporized so that the pressure of the ink 13 in the selected nozzles 19 is rapidly increased.

As a result, drops of ink 21 are discharged from the selected nozzles 19 to print out a letter on a line of the recording paper 22. In this case, the print of a series of letters on a line is accomplished when the ink jet cartridge 11 is moved from one end of the printer to the other end in an axis direction of the platen 23. Thereafter, the recording paper 22 is sent out by the platen 23 so that letters are printed out on a following line of the recording paper 22 in the same manner.

Accordingly, the recording paper 22 can be printed out by the drops of ink 21 discharged from the conventional ink jet cartridge 11.

2.2 Problems to be Solved by the Invention

However, in cases where the conventional ink jet cartridge 11 is thinned to miniaturize the ink jet printer, the stiffness of the body 14 deteriorates. Also, in cases where the wall thickness of the body 14 is thinned to manufacture a thin type ink jet cartridge to miniaturize the printer, the stiffness of the cartridge deteriorates in the same manner. Therefore, when the conventional ink jet cartridge 11 is put in the printer, the body 14 is elastically pressed by operator's fingers and/or the printer so that the body 14 is distorted and the porous material forming the ink packing portion 12 is pressed. As a result, the ink 13 is forcibly pressed out. That is, the leakage of the ink 13 is generated.

Also, because the ink 13 is injected in the porous material, the ink 13 permeates the porous material. Therefore, some ink 13 necessarily remains in the porous material even though the cartridge 11 is used up and no more ink 13 is not supplied to the nozzles 19. In addition, in cases where the cartridge 11 is miniaturized, the ratio of the remaining ink 13 to the packed ink 13 is increased. Therefore, the effective volume of the ink 13 is decreased. Accordingly, the cartridge 11 cannot be used for a long time and 11 must be often exchanged for another.

Also, the volume of the remaining ink 13 in the conventional ink jet cartridge 11 cannot be checked because the ink packing portion 12 is sealed by the body 14 and the cover 15. In addition, even though the body 14 is made of transparent material to make the ink packing portion 12 visible, the volume of the remaining ink 13 cannot be checked because the ink 13 permeates the porous material. That is, even though a comparatively large volume of ink 13 is consumed, it is difficult to distinguish the color change of the surface of the porous material.

Also, in cases where a user exchanges a used cartridge 11 for a new one because the ink 13 in the used cartridge 11 is consumed, the user often touches the nozzles 19 because the nozzles 19 are exposed. Therefore, the user stains his fingers with the ink 13, and dust sticks to the nozzles 19 so that the nozzles 19 are sealed. In addition, when the new cartridge 11 is attached to an ink jet printer, the cartridge 11 is sometimes hit against the printer so that the nozzles 19 are damaged. Therefore, drops of ink 21 cannot be discharged from the new cartridge 11.

Also, as shown in FIG. 3, in cases where a perforated continuous paper 25 is utilized as the recording paper 22, a perforated portion 26 of the paper 25 touches the nozzles 19 of the cartridge 11 so that the paper 25 is stained.

Finally, as shown in FIG. 4, in cases where the recording paper 22 is curved or bent to float above the platen 23 because the recording paper 22 is not smoothly sent out by the platen 23, a curved portion of the paper 25 touches the nozzles 19 of the cartridge 11 so that the paper 25 is stained with the ink 13.

SUMMARY OF THE INVENTION

A first object of the present invention is to provide, with due consideration to the drawbacks of such a conventional ink jet cartridge, a thin type ink jet cartridge in which the leakage of the ink 13 does not occur even though the cartridge is thinned and external forces are applied on the cartridge.

A second object of the present invention is to provide a thin type ink jet cartridge in which ink packed in the cartridge is almost consumed even though the cartridge is thinned.

A third object of the present invention is to provide a thin type ink jet cartridge in which the volume of remaining ink is easily checked before the cartridge is exchanged for a new one.

A fourth object of the present invention is to provide a thin type ink jet cartridge which is not damaged and does not stain a medium of record with ink when the cartridge is exchanged.

A fifth object of the present invention is to provide a thin type ink jet cartridge which does not stain a medium of record such as a perforated continuous paper.

The first object is achieved by the provision of a thin type ink jet cartridge comprising:

ink holding means for holding ink in a thin type ink case;

reinforcing means for structurally reinforcing the thin type ink case of the ink holding means to enhance the structural strength of the thin type ink case; and ink discharging means for discharging the ink held in the thin type ink case of the ink holding means at a medium of record.

In the above configuration of the thin type ink jet cartridge, the ink held in the thin type ink case of the ink holding means is discharged at the medium of record in a normal operation when a discharging signal is transmitted from a printer to the thin type ink jet cartridge.

Also, regardless of the normal operation, in cases where the thin type ink case receives external forces, the ink held in the thin type of ink case easily leaks out from the ink case in a conventional ink jet cartridge because the structural strength of the thin type ink case is generally inferior to a box type ink case.

However, because the structural strength of the thin type ink case is enhanced by the reinforcing means in the present invention, the thin type ink case is hardly deformed even though the external forces are applied on the ink case. Therefore, the ink held in the thin type ink case hardly leaks out from the ink case.

Accordingly, the ink can be discharged from the cartridge at the medium of record without leaking.

It is preferable that the reinforcing means be a large number of ribs arranged over the entire thin type ink case of the ink holding means.

In the above configuration, the thin type ink case is reliably enhanced by the structural strength of the ribs.

Moreover, it is preferable that the reinforcing means be a swirl-shaped beam arranged over the entire thin type ink case of the ink holding means.

In the above configuration, the thin type of ink case is reliably enhanced by the structural strength thereof by the beam.

The second object is achieved by the provision of a thin type ink jet cartridge comprising:

ink holding means for holding ink in a passageway extending in a flat shape;

accommodating means for accommodating the passageway of the ink holding means in a thin type ink case; and ink discharging means for discharging the ink held in the passageway of the ink holding means at a medium of record.

In the above configuration of the thin type ink jet cartridge, the ink held in the passageway of the ink holding means is discharged at a medium of record. In this case, because no porous material is provided to hold the ink, the ink is held in the whole passageway. Therefore, all of the ink held in the passageway is discharged at the medium of record.

Accordingly, the ink held in the passageway can be effectively used up until the passageway becomes almost empty.

It is preferable that the thin type ink jet cartridge further comprises an equalizing hole for equalizing the pressure in the passageway of the ink holding means with atmospheric pressure applied on the medium of record, atmospheric air coming into the passageway through the equalizing hole to compensate for the reduction of the ink held in the passageway.

In the above configuration, the volume of the ink held in the passageway is reduced when the ink is discharged at the medium of record. At this time, the atmospheric air comes into the passageway through the equalizing hole to compensate for the reduction of the ink. That is, the pressure in the passageway is always equalized with the atmospheric pressure by the atmospheric air. Therefore, the ink held in the passageway is continuously supplied to the ink discharging means according to the capillary phenomenon.

Accordingly, the ink held in the passageway can be continuously supplied to the ink discharging means until the ink held in the passageway almost becomes empty.

Also, it is preferable that the passageway of the ink holding means be an opening formed in the thin type ink case of the accommodating means, the cross-sectional area of the opening being constant.

In the above configuration, even though the volume of the accommodating means is small as compared with a box type ink case, the volume of the ink held in the opening is comparatively large.

Accordingly, a prescribed volume of the ink required for a conventional ink jet cartridge can be effectively held in the opening in the present invention.

Also, it is preferable that the passageway of the ink holding means extend in a deformable tube set in the thin type ink case of the accommodating means.

In the above configuration, the ink is effectively held in the deformable tube in the same manner as the opening formed in the ink case. In addition, the injection of the ink into the deformable tube is easier than that into the opening because the ink is injected into the tube before the tube is set in the thin type ink case.

Also, it is preferable that the thin type ink case of the accommodating means be formed by transparent material.

In the above configuration, a user can check the remaining volume of the ink held in the passageway because the thin type ink case accommodating the passageway is formed by the transparent material. Therefore, a third object can be achieved.

In addition to the ink case formed by the transparent material, it is preferable that a graded scale be put on the thin type of ink case.

In the above configuration, a user can quantitatively check the remaining volume of the ink held in the passageway because the graded scale is put on the thin type ink case.

The fourth object is achieved by the provision of a thin type ink jet cartridge comprising:

ink holding means for holding ink in a thin type ink case;

ink discharging means for discharging the ink held in the thin type ink case of the ink holding means at a medium of record; and covering means for covering the ink discharging means with a shutter when the ink is not discharged from the ink discharging means, the shutter being moved away from the ink discharging means when the ink is discharged from the ink discharging means.

In the above configuration of the thin type ink jet cartridge, when the ink is not discharged from the ink discharging means, the ink discharging means is covered with the shutter, for example, loaded by a spring. On the other hand, when the ink is discharged from the ink discharging means, the shutter is moved away from the ink discharging means, for example, by the action of an electric solenoid.

Therefore, in cases where the ink jet cartridge is taken off from a printer in which the medium of record is left set, the medium of record is not stained with the ink because the ink discharging means is covered with the shutter. Also, in cases where the ink jet cartridge is set in the printer, the medium of record is not stained with the ink in the same manner. In addition, even if the cartridge is hit against the printer, the ink discharging means is not damaged because the ink discharging means is covered with the shutter.

Accordingly, a user can easily exchange a used cartridge for a new one without any trouble.

In addition, after the exchange of the cartridge, the ink held in the passageway is not vaporized from the ink discharging means. Moreover, the ink discharging means is not sealed with dust.

The fifth object is achieved by the provision of a thin type ink jet cartridge comprising:

ink holding means for holding ink in a thin type ink case;

ink discharging means for discharging the ink held in the thin type ink case of the ink holding means at a medium of record; and protecting means for protecting the medium of record from the contact with the ink discharging means by surrounding the ink discharging means with a protecting plate, the ink discharging means being positioned at a concave portion surrounded by the protecting plate.

In the above configuration of the thin type of ink jet cartridge, the protecting plate with prescribed thickness is attached to surround the ink discharging means. Therefore, the ink discharging means is positioned at a concave portion surrounded by the protecting plate. The depth of the concave portion equals the thickness of the protecting plate.

Therefore, even though the medium of record is curved to touch the cartridge, because the medium of record touches the protecting plate, the protecting plate prevents the medium of record from touching the ink discharging means.

Accordingly, the medium of record is not stained with the ink.

The first and second objects are achieved by the provision of a thin type ink jet cartridge comprising:

ink holding means for holding ink in a passageway extending in a flat shape;

accommodating means for accommodating the passageway of the ink holding means in a thin type ink case;

reinforcing means for structurally reinforcing the thin type of ink case the accommodating means to enhance the structural strength of the thin type of ink case; and ink discharging means for discharging the ink held in the passageway of the ink holding means at a medium of record.

In the above configuration of the thin type ink jet cartridge, the ink is held in the passageway because no porous material is packed in the passageway. In addition, even though the ink case is thinned, the thin type ink case is not deformed by any external forces because the structural strength of the ink case is enhanced.

Accordingly, even though the cartridge is thinned, the ink is effectively held and the cartridge is not deformed.

A printing operation in which the first and second objects are achieved is implemented by a printing system for printing out information on a medium of record, comprising:

supporting and transferring means for supporting the medium of record and transferring the medium of record in a transferring direction;

a thin type ink jet cartridge for discharging drops of ink indicating the information at the medium of record supported by the supporting means, wherein the thin type ink jet cartridge comprises ink holding means for holding ink in a passageway extending in a flat shape, accommodating means for accommodating the passageway of the ink holding means in a thin type ink case, reinforcing means for structurally reinforcing the thin type ink case of the accommodating means to enhance the structural strength of the thin type ink case, ink discharging means for discharging the drops of ink held in the passageway of the ink holding means at the medium of record, and discharging signal transmitting means for transmitting a discharging signal to the ink discharging means to order the discharge of the ink;

carriage means for moving the thin type ink jet cartridge in a direction perpendicular to the transferring direction; and control means for controlling the transfer of the medium of record in the supporting means and the movement of the thin type ink jet cartridge in the carriage means and transmitting the discharging signal to the discharging signal transmitting means of the thin type ink jet cartridge.

In the above configuration of the printing system, the medium of record is transferred by the supporting and transferring means under the control of the control means. Also, the cartridge achieving the first and second objects is moved by the carriage means under the control of the control means. Therefore, when the discharging signal is transmitted from the control means to the ink discharging means through the discharging signal transmitting means, the drops of ink by which letters indicating the information are formed are discharged at the medium of record. As a result, the information is printed out on the medium of record.

Accordingly, the printing system can be miniaturized.

BRIEF DESCRIPTION OF THE DRAWINGS

The objects, features and advantages of the present invention will be apparent from the following description taken in conjunction with the accompanied drawings, in which.

DETAILED DESCRIPTION OF THE PREFERRED EMBODIMENTS

A thin type ink jet cartridge according to the present invention is described in detail with reference to the accompanied drawings.

Figure 1:
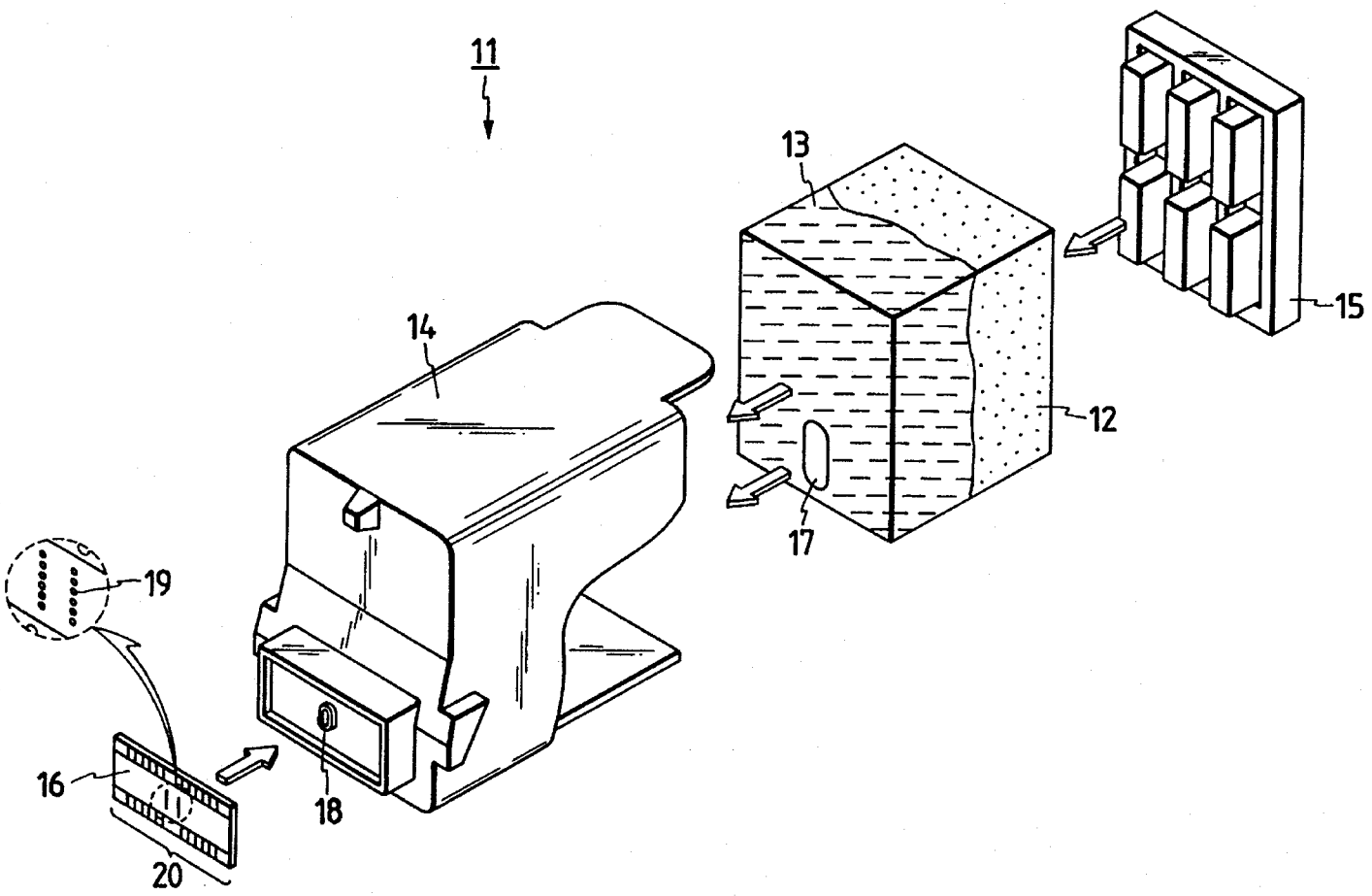
FIG. 1 PRIOR ART
FIG. 1 is a disassembled diagonal view of a conventional ink jet cartridge.
Figure 2A:
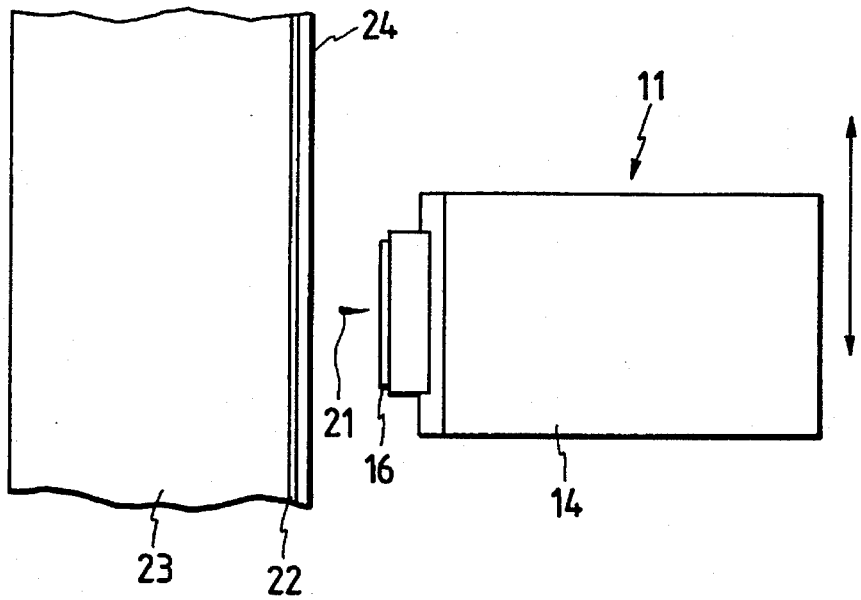
FIG. 2A PRIOR ART
FIG. 2A is a plan view showing a drop of ink discharged at a recording paper from the cartridge shown in FIG. 1.
Figure 2B:
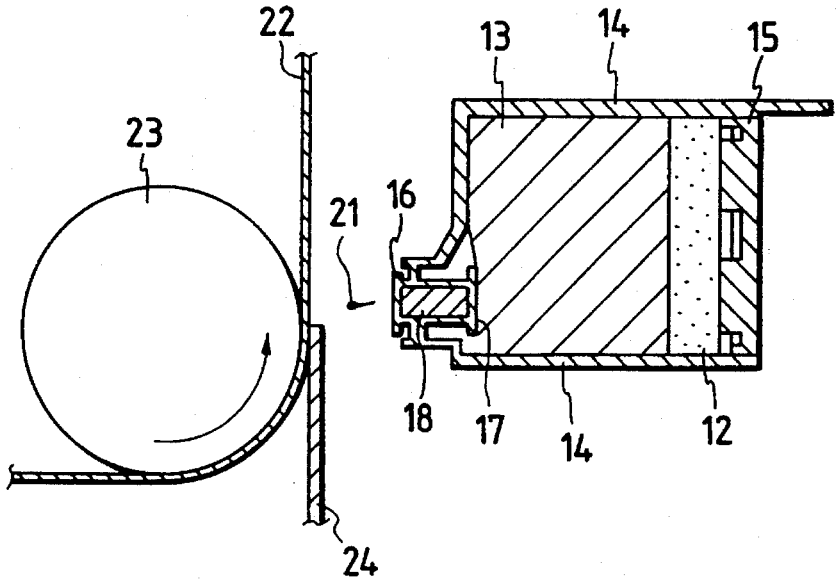
FIG. 2B PRIOR ART
FIG. 2B is a side sectional view showing a drop of ink discharged at a recording paper from the cartridge shown in FIG. 1.
Figure 3:
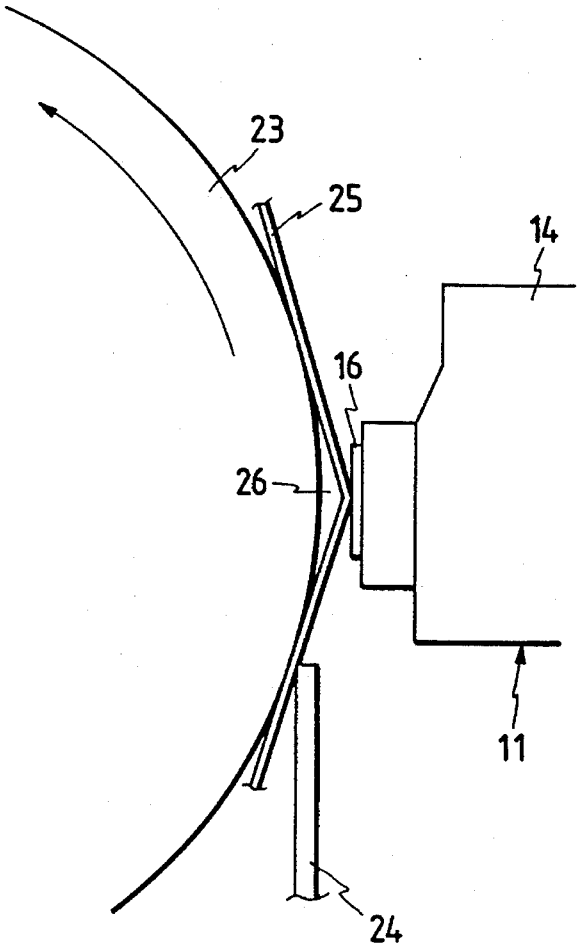
FIG. 3 PRIOR ART
FIG. 3 is a side view showing a perforated continuous paper touching the cartridge shown in FIG. 1.
Figure 4:
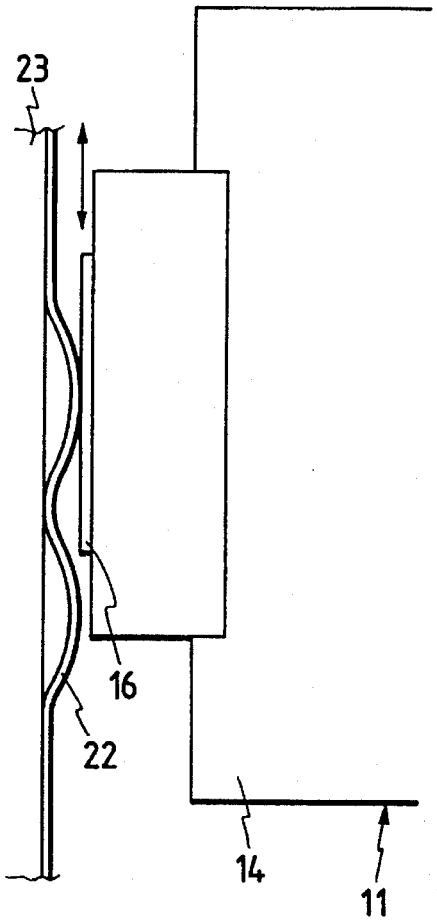
FIG. 4 PRIOR ART
FIG. 4 is a side view showing a curved recording paper touching the cartridge shown in FIG. 1.
Figure 5:
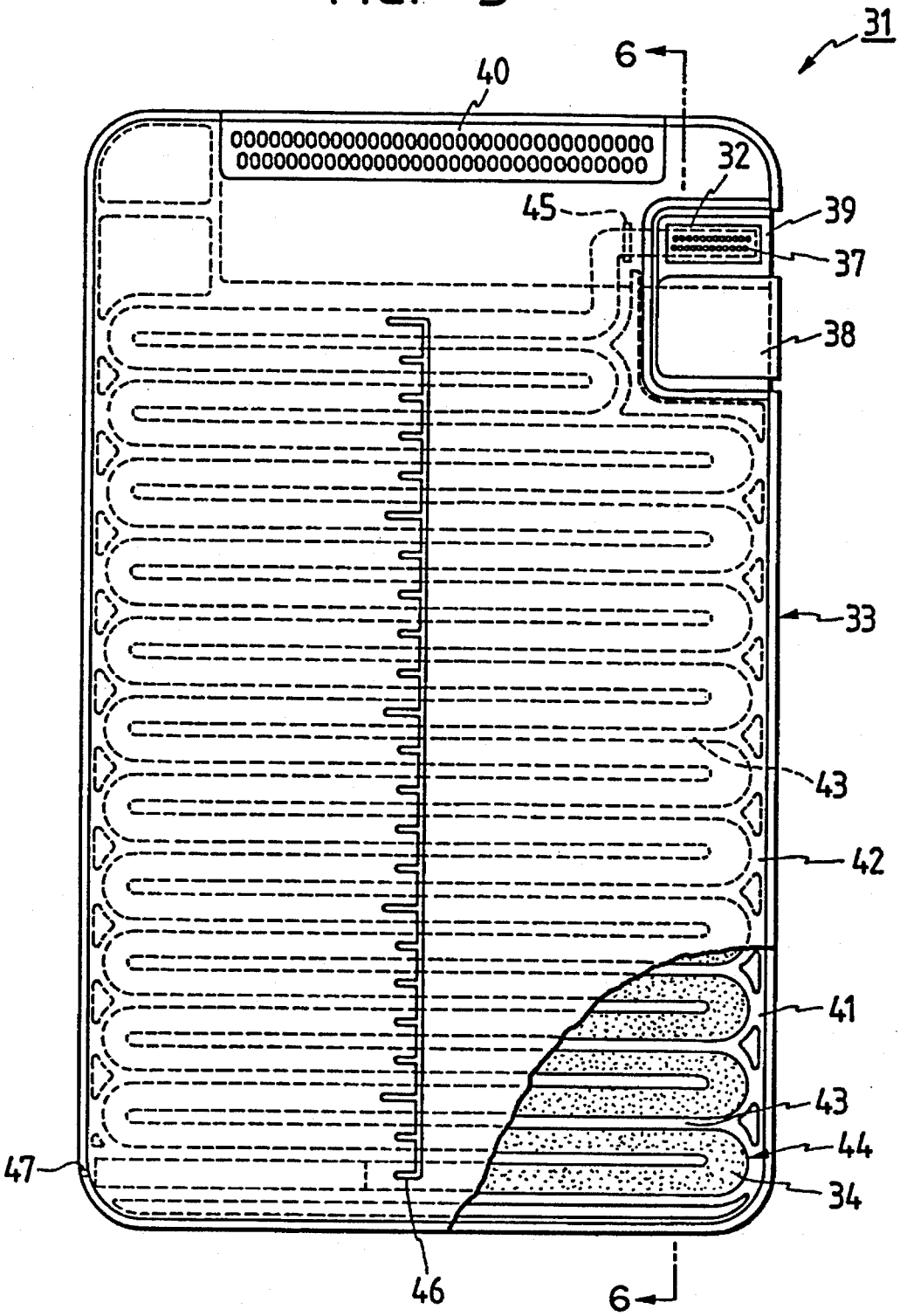
FIG. 5 is a plan view of a thin type ink jet cartridge according to an embodiment of the present invention, perspectively showing the cartridge.
Figure 6:
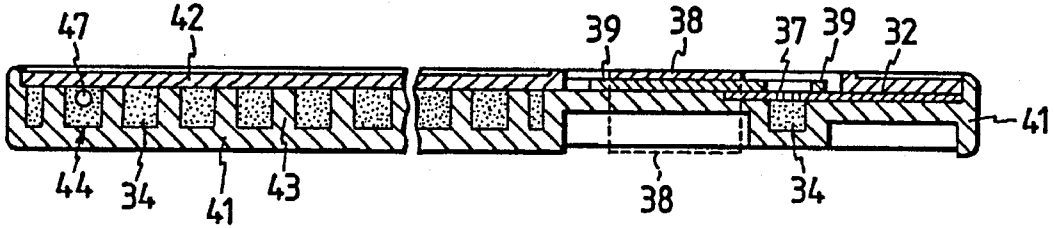
FIG. 6 is a side sectional view taken generally along the lines 6—6 of FIG. 5.
Figure 7A:
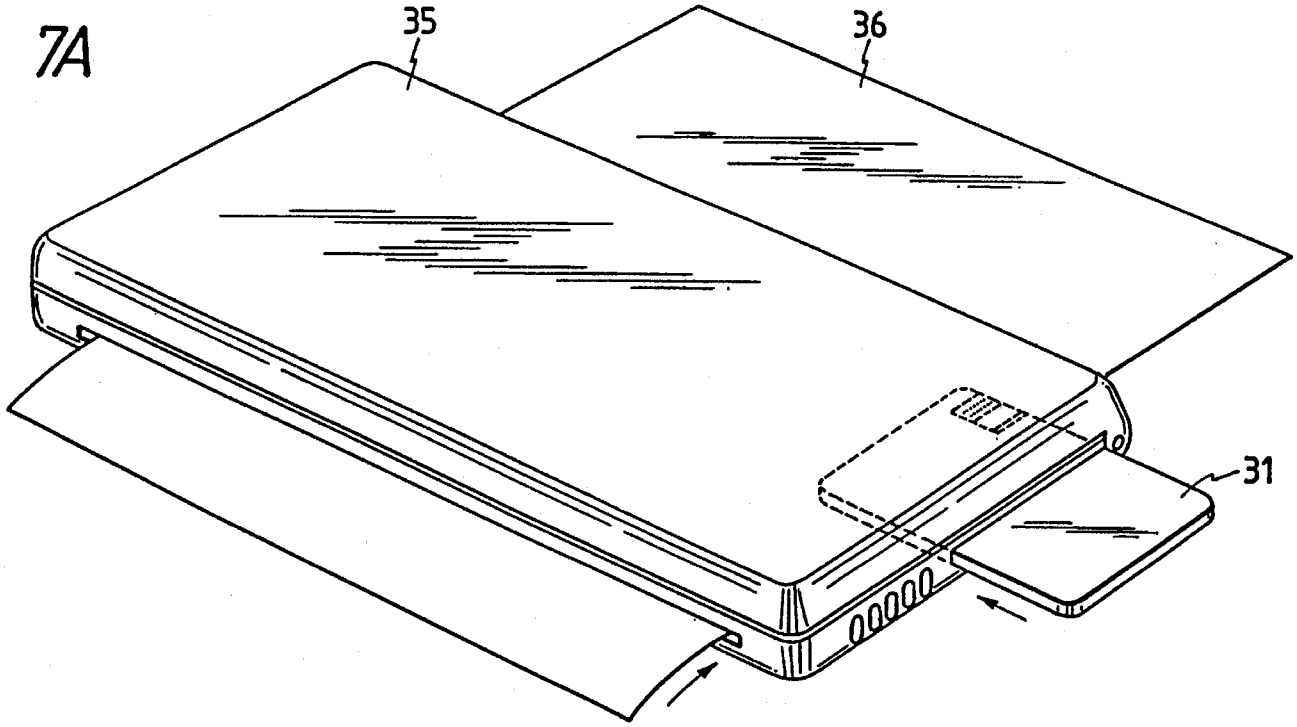
FIG. 7A is a diagonal view showing a print operative of an ink jet printer in which the cartridge shown in FIG. 5 is inserted.

FIG. 5 is a plan view a thin type of ink jet cartridge according to an embodiment of the present invention, and FIG. 6 is a side sectional view taken generally along the lines 6—6 of FIG. 5. In addition, FIG. 7A is a perspective view of an ink jet printer in which the cartridge shown in FIG. 5 is inserted, showing a print operation.

Figure 7B:
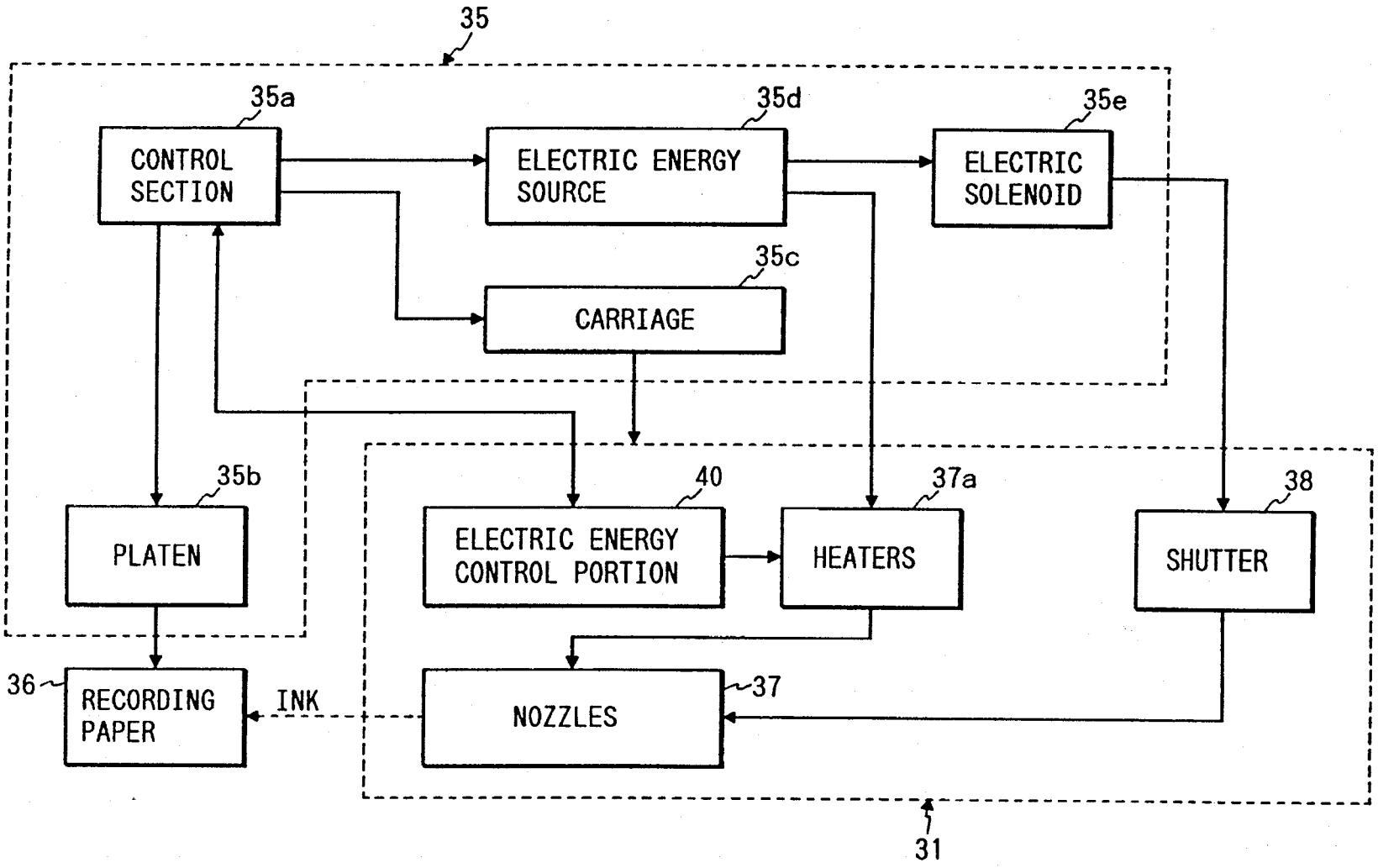
FIG. 7B is a block diagram showing a printing operation implemented by the printer shown in FIG. 7A.

As shown in FIGS. 5 and 6 a thin type ink jet cartridge 31 according to an embodiment of the present invention comprises a head substrate 32 on which many elements are mounted to discharge drops of ink and a thin type ink case portion 33 in which ink 34 is held. Moreover, as shown in FIGS. 7A and 7B, the cartridge 31 is set in an ink jet printer 35 to discharge the drops of ink 34 at a medium of record such as a recording paper 36 according to a discharging signal transmitted from a control section 35*a* of the printer 35. The recording paper 36, including a perforated continuous paper, is transferred by a platen 35*b*. In addition, the cartridge 31 is set to be movable in a direction perpendicular to a transferred direction of the recording paper 36. That is, the cartridge 31 is moved from one side of the printer 35 to the other side by the action of a carriage 35*c* to print out letters formed by the drops of ink 34 along a line of the recording paper 36. After the letters are printed out on a line, the recording paper 36 is transferred, one line at a time, by the platen 35*b*. Therefore, the letters are finally printed out on the entire recording paper 36 by the printer 35.

Moreover, the cartridge 31 further comprises a plurality of ink discharging nozzles 37 from which the drops of ink 34 are discharged, a shutter 38 for covering the nozzles 37 to prevent the ink 34 from leaking and vaporizing and to prevent dust from sealing the nozzles 37 when the cartridge 31 is not operated, a protecting plate 39 for protecting a recording paper 36 from the contact with the nozzles 37, and an electric energy control portion 40 for controlling the discharge of the ink 34 from the nozzles 37. The nozzles 37, the shutter 38, the protecting plate 39 and the control portion 40 are mounted on the base substrate 32 and are integrally formed with one another.

In the ink discharging nozzles 37, heaters 37*a* are provided to heat the ink 34 supplied in the nozzles 37. Each of the heaters 37*a* corresponds to a nozzle 37.

In the electric energy control portion 40, the heaters 37*a* to be energized from an electric energy source 35*d* under the control of the control section 35*c* are selected according to the discharging signal transmitted from control section 35*a* of the printer 35. That is, the ink 34 supplied in the nozzles 37 which correspond to the heaters 37*a* selected by the control section 35*a* is heated up until a piece of ink 34 is vaporized in the nozzles 37. Therefore, the drops of the ink 34 are discharged at the recording paper 36 because the pressure in the nozzles 37 is rapidly increased.

The shutter 38 is movable to cover the nozzles 37. In detail, the nozzles 37 are reliably covered by the shutter 38 loaded by a spring when the cartridge 31 is not operated, while the shutter 38 is moved away from the nozzles 37 by the action of an electric solenoid 35*e* when the discharging signal is transmitted to the control portion 40. That is, the electric solenoid 35*e* is acted under the control of the control section 35*a* of the printer 35. The shutter 38 is made of stainless steel which has superior corrosion resistance and stiffness. Therefore, the shutter 38 is not corroded by the ink 34 so that rust or dirt is not generated on the shutter 38. As a result, the nozzles 37 are not sealed by rust and/or dirt. In addition, even though the shutter 38 is moved many times, the shutter 38 is not deformed because of the superior stiffness of the stainless steel. Therefore, the nozzles 37 can be reliably covered with the shutter 38 many times for a long time.

Figure 8:
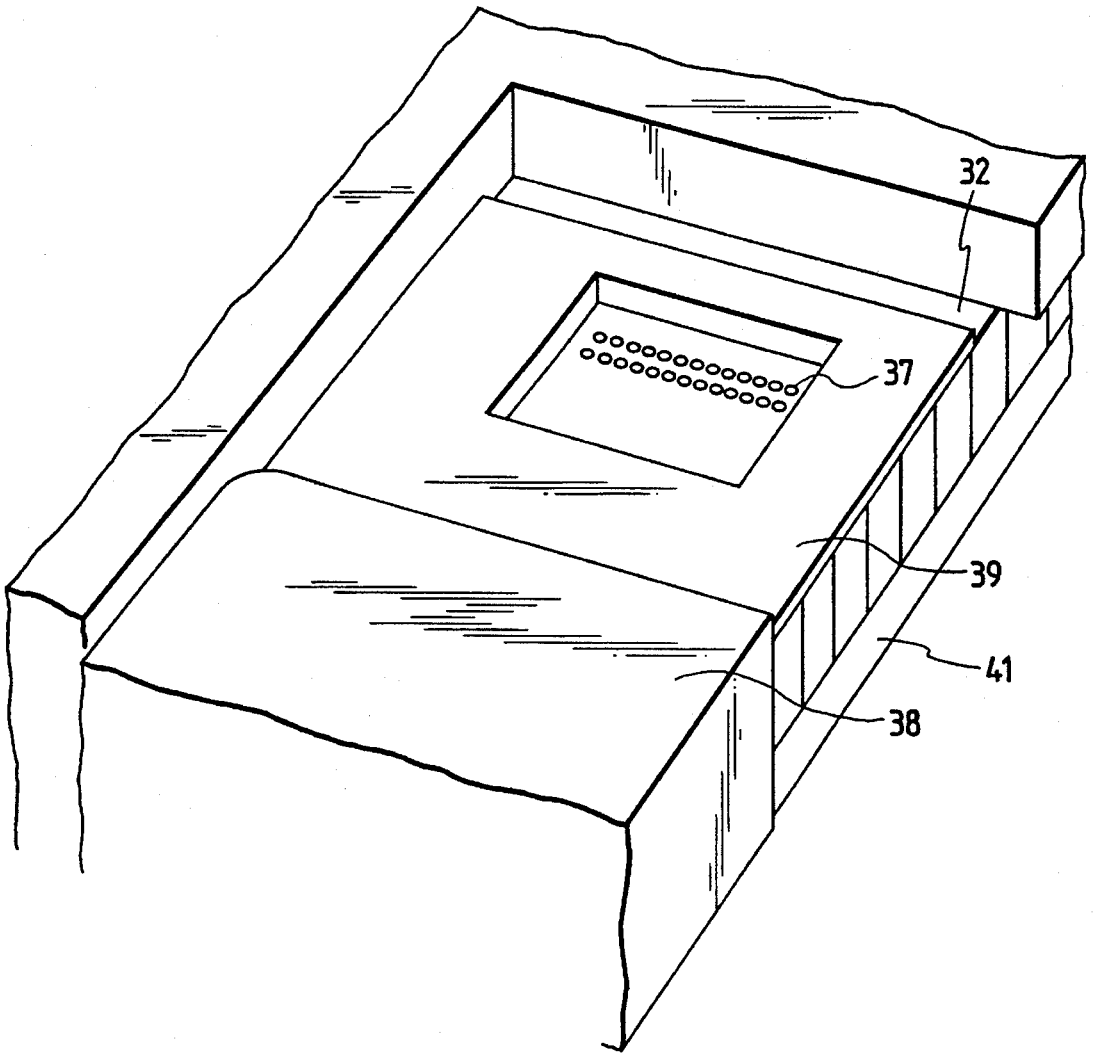
FIG. 8 is a perspective view showing elements surrounding nozzles of the cartridge shown in FIG. 5 on an enlarged scale.

The protecting plate 39 is attached on the base substrate 32 to surround the nozzles 37, as shown in FIG. 8. When the nozzles 37 are covered with the shutter 38, the protecting plate 39 is also covered with the shutter 38. When the cartridge 31 is operated, the protecting plate 39 is positioned between the recording paper 36 and the nozzles 37 because the shutter 38 is moved away. Therefore, even though a perforated continuous paper is utilized as the medium of record, the protecting plate 39 protects the paper from the contact with the nozzles 37.

In addition, as shown in FIG. 5, the cartridge 31 further comprises a square-shaped ink holder 41 for supporting the head substrate 32 and holding the ink 34 in a shallow concavity of the ink case portion 33, a square-shaped ink cover 42 arranged at the ink case portion 33 for covering the holder 41 with a flat plate to seal the ink 34, a large number of reinforcing ribs 43 which are arranged in an opening formed in the shallow concavity to form a snaky passageway 44 which is surrounded by the ink holder 41 and the ink cover 42, and a filter 45 provided at one end of the snaky passageway adjacent to the nozzles 37 for filtering the dirt and bubbles contained in the ink 34 which is held in the snaky passageway 44. The ink case portion 33 is formed by the ink holder 41, the ink cover 42 and the reinforcing ribs 43, and the passageway 44 is accommodated by both the ink holder 41 and the ink cover 42. In addition, as shown in FIG. 6, the ink holder 41 and the reinforcing ribs 43 are integrally formed with each other to form one piece in this embodiment. Therefore, the reinforcing ribs 43 are also useful in structurally reinforcing the thin type ink case portion 33. Therefore, the structural strength of the thin type ink case portion 33 is enhanced by the reinforcing ribs 43.

The ink holder 41 and the ink cover 42 are respectively formed by transparent resin such as polyethylene terephthalate and polyether sulfone. Therefore, the ink 34 held in the snaky passageway 44 is visible to the naked eye. Also, a graded scale 46 is put on the ink cover 42 to quantitatively check the remaining volume of the ink 34.

Moreover, an equalizing hole 47 is provided at the other end of the snaky passageway to equalize the pressure of the snaky passageway 44 with atmospheric pressure. Therefore, even though the ink 34 held in the snaky passageway 44 is reduced by a printing operation, the pressure of the snaky passageway 44 is maintained at the atmospheric pressure.

In the above configuration of the thin type ink jet cartridge 31, because the structural strength such as the stiffness of the ink case portion 33 is enhanced by the reinforcing ribs 43 arranged over the entire ink case portion 33, the ink case portion 33 is not deformed by external forces even though the ink case portion 33 is thinned. Therefore, the snaky passageway 44 is not deformed by the external forces so that the ink 34 is prevented from leaking to the outside.

Next, a printing operation is described.

All of the nozzles 37 are always filled up with the ink 34 held in the snaky passageway 44 according to the capillary phenomenon, and the nozzles 37 are covered with the spring-loaded shutter 38 to prevent the ink 34 from leaking or vaporizing. In addition, the nozzles 37 are not sealed with the dust because the shutter 38 prevents dust from attaching to the nozzles 37.

When a discharging signal is transmitted from the control section **35*a* of the printer 35 to the control portion 40 after the cartridge 31 is set in the printer 35, the shutter 38 is moved away from the nozzles 37 by the action of the electric solenoid 35*e*. Thereafter, the ink 34 contained in the nozzles 37 corresponding to the heaters 37*a* selected by the control section 35*a* according to the discharging signal is selectively boiled by the heaters 37*a* so that the drops of ink 34 are discharged from the nozzles 37 to the recording paper 36 without being disturbed by the shutter 38. In other words, information such as letters is printed on the recording paper 36** according to the discharging signal.

After the ink 34 is discharged from the nozzles 37, the ink 34 held in the snaky passageway 44 is supplied to the nozzles 37 to compensate for lack of the ink 34 according to the capillary phenomenon. At this time, dirt and bubbles contained in the ink 34 are removed by the filter 45. Also, atmospheric air is supplied into the snaky passageway 44 through the equalizing hole 47 to equalize the pressure of the snaky passageway 44 with the atmospheric pressure. Therefore, the ink 34 held in the snaky passageway 44 is instantly supplied in the nozzles 37 according to the capillary phenomenon, which is generated as follows. When the ink 34 is discharged from the nozzles 37, negative pressure is instantly generated in the nozzles 37. Therefore, the ink 34 held in the passageway 44 is pushed out towards the nozzles 37 by the atmospheric air supplied through the equalizing hole 47.

In addition, the information is printed out on the recording paper 36 in succession according to discharging signals sequentially transmitted to the control portion 40. In detail, after the recording paper 36 receives the drops of ink 34 discharged from the cartridge 31 set in the printer 35 to print out a letter on the paper 36, the cartridge 31 is moved by the carriage **35*c* in a direction perpendicular to a transferring direction of the recording paper 36 which is sent out by the platen 35*b*. When the cartridge 31 is moved from one end of the printer 35 to the other end, an operation for printing out on a line of the recording paper 36 is finished. After the operation, the recording paper 36 is sent out by the platen 35*b* to print out on a following line of the recording paper 36. As a result, the information is printed out on a prescribed number of lines of the recording paper 36**.

Figure 9:
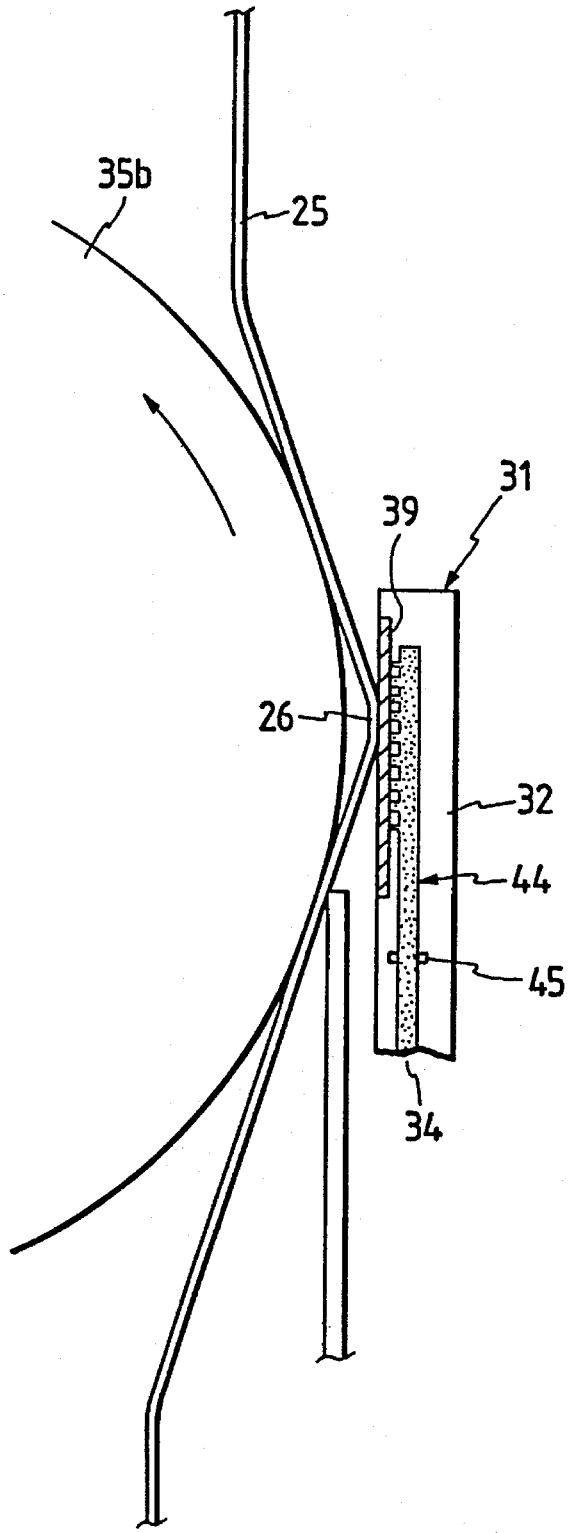
FIG. 9 is a side view of a perforated continuous paper touching the cartridge shown in FIG. 5, showing that a protecting plate prevents the perforated continuous paper from touching nozzles.

In this case, the recording paper 36 sometimes floats above the platen **35*b*, as shown in FIG. 9, when the perforated continuous paper 25 is utilized as the recording paper 36. Therefore, the perforated portion 26 of the perforated continuous paper 25 touches the cartridge 31. However, because the protecting plate 39 with a prescribed thickness is attached on the base substrate 32 to surround the nozzles 37, the perforated portion 26 of the paper 25 directly touches the protecting plate 39. Therefore, the perforated portion 26 of the paper 25 does not touch the nozzles 37 which are positioned at a concave portion surrounded by the protecting plate 39**.

Accordingly, the perforated continuous paper 25 is not stained with the ink 34 supplied in the nozzles 37. Also, the nozzles 37 are not mechanically damaged by the paper 25. That is, the fifth object can be achieved.

Figure 10:
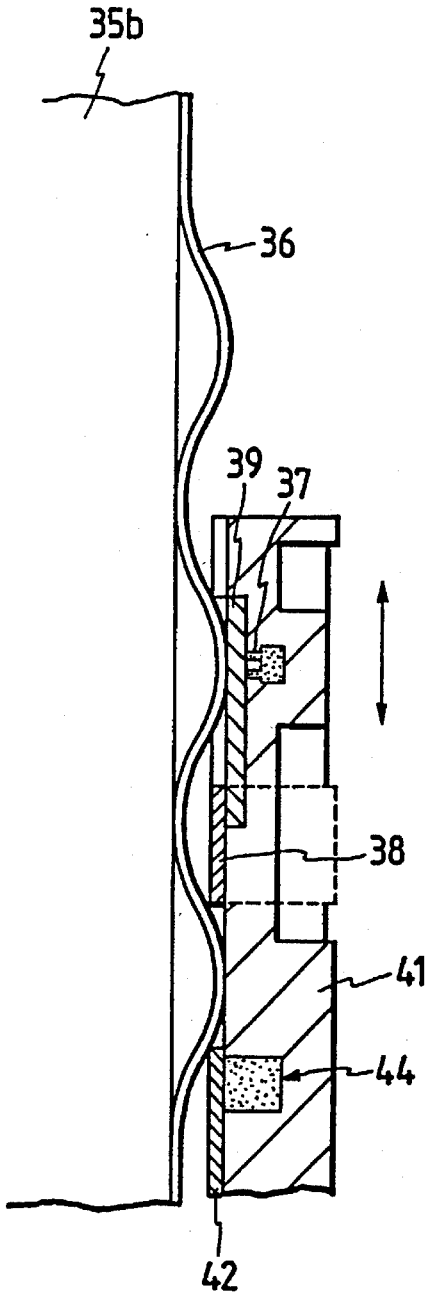
FIG. 10 is a side view of a curved recording paper touching the cartridge shown in FIG. 5, showing that a protecting plate prevents the curved recording paper from touching nozzles.

Also, when the recording paper 36 is curved or bent because the recording paper 36 is not smoothly sent out by the platen **35*b*, the recording paper 36 sometimes floats above the platen 35*b*. Therefore, as shown in FIG. 10, the curved portion of the recording paper 36 touches the cartridge 31. However, the curved portion of the recording paper 36 does not touch the nozzles 37 in the same manner. Therefore, the recording paper 36 is not stained with the ink 34, and the nozzles 37** are not mechanically damaged.

During the above operation for printing out the information on the recording paper 36, the ink 34 held in the snaky passageway 44 is gradually reduced. In this case, because the ink holder 41 and the ink cover 42 are formed by the transparent resin, the reduction of the ink 34 held in the snaky passageway 44 is easily checked through the transparent resin from the outside. In addition, because the graded scale 46 is put on the ink cover 42, the remaining volume of the ink 34 is quantitatively checked.

The printing operation is continued until the ink 34 held in the snaky passageway 44 almost becomes empty. The reason is because the ink 34 is held in the passageway 44 without permeating any porous material.

When the ink 34 held in the snaky passageway 44 almost becomes empty, an empty signal is transmitted from the control portion 40 to the control section 35*a* of the printer 35 so that the printing operation is stopped. In addition, the nozzles 37 are covered with the spring-loaded shutter 38 to prevent user's fingers and/or the recording paper 36 from being stained. Therefore, a user can easily take out the used cartridge 31 without staining the user's fingers and/or the recording paper 36 with the ink 34. After taking out the used cartridge 31, the user sets a new cartridge 31 in the printer 35 in which the recording paper 36 is left set. In this case, the nozzles 37 of the new cartridge 31 are reliably covered with the spring-loaded shutter 38. Therefore, the user can easily set the new cartridge 31 in the printer 35 without staining the user's fingers and/or the recording paper 36. In addition, even though the new cartridge 31 is hit against the printer 35, the nozzles 37 are not necessarily damaged by external forces because the nozzles 37 are covered with the shutter 38 having superior stiffness.

Accordingly, because the ink case portion 33 is structurally reinforced by the reinforcing ribs 43 arranged over the entire ink case portion 33 to enhance the structural strength of the ink case portion 33, the ink case portion 33 is not deformed by any external force even though the ink case portion 33 is thinned. Therefore, the snaky passageway 44 is not deformed by any external force so that the ink 34 is prevented from leaking to the outside. That is, the first object can be achieved.

Moreover, because the ink 34 does not permeate any porous material and the capillary phenomenon functions until the ink 34 held in the snaky passageway 44 almost becomes empty, the printing operation can be continued until the ink 34 held in the snaky passageway 44 almost becomes empty. Therefore, the ink 34 can be effectively used up. In addition, because the opening surrounded by both the ink holder 41 and the ink cover 42 is not occupied by any porous material, the opening can be effectively utilized to hold the ink 34. Therefore, even though the thin type of ink jet cartridge 31 is utilized, the volume of the ink 34 is enough to print out letters on the recording paper 36. That is, the second object can be achieved.

Moreover, because the ink holder 41 and the ink cover 42 are formed by the transparent resin, the reduction of the ink 34 held in the snaky passageway 44 can be easily checked when a user merely looks at the snaky passageway 44 through the transparent resin from the outside. In addition, because the graded scale 46 is put on the ink cover 42, the remaining volume of the ink 34 can be quantitatively checked. That is, the third object can be achieved.

Moreover, because the nozzles 37 are reliably covered with the spring-loaded shutter 38 when drops of ink 34 are not discharged from the nozzles 37, a user can easily take out the cartridge 31 without staining his fingers and/or the recording paper 36 with the ink 34. In addition, the user can easily set the cartridge 31 in the printer 35 without staining his fingers and/or the recording paper 36. Further, when the cartridge 31 is set in the printer 35, the nozzles 37 are not necessarily damaged by the external forces. That is, the forth object can be achieved.

In the above embodiment, though the ink holder 41 and the ink cover 42 are formed by the transparent material, because the remaining volume of the ink 34 can be checked through the ink cover 42, it is within the scope of the present invention that only the ink cover 42 is formed by the transparent material. In this case, it is preferable that the ink holder 41 be formed by plastics such as denatured polyphenylene oxide and polyethylene terephthalate which have superior chemical resistance and stiffness.

Also, it is within the scope of the present invention that a transparent portion 42*a* is formed at a part of the ink cover 42. In this case, as shown in FIG. 11, it is preferable that the graded scale 46 be put on the transparent portion 42*a*.

Also, it is within the scope of the present invention that a colored label with scale be put on the ink cover 42 in place of the graded scale 46. In this case, a user can easily judge the remaining volume of the ink 34 as compared with the graded scale 46.

Figure 11:
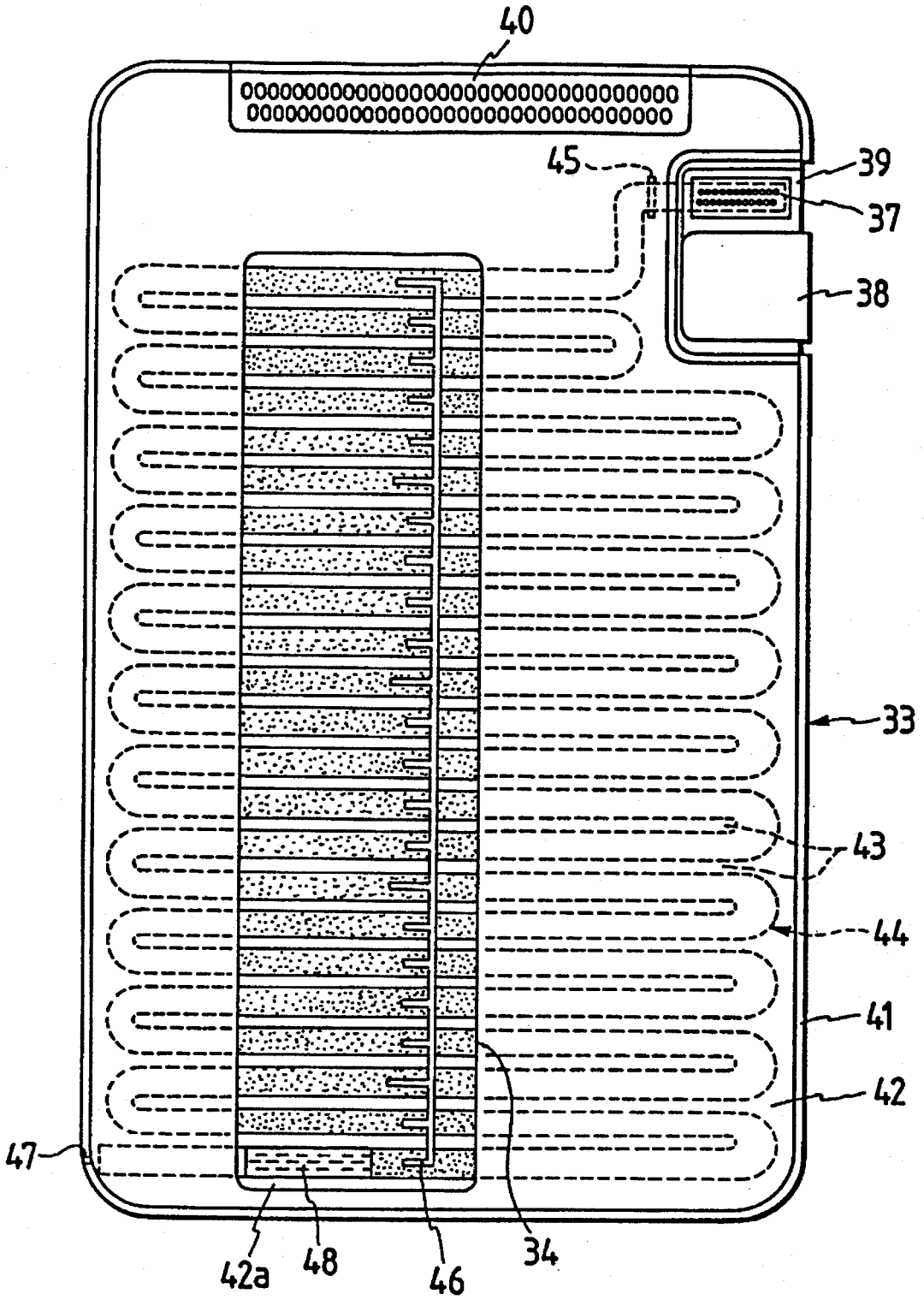
FIG. 11 is a plan view of a thin type ink jet cartridge according to another embodiment of the present invention.

Also, as shown in FIG. 11, it is within the scope of the present invention that a viscous fluid 48 is injected into the snaky passageway 44 after the ink 34. In this case, because the viscous fluid 48 is arranged between the end of the ink 34 held in the passageway 44 and the atmospheric air, a user can easily distinguish the end of the ink 34. Moreover, the ink 34 held in the snaky passageway 44 is completely supplied to the nozzles 37 because the ink 34 will not stick on the wall of the passageway 44. Further, the viscous fluid 48 prevents the ink 34 from oxidizing because the ink 34 held in the passageway 44 is not exposed to the atmospheric air. Furthermore, in cases where the viscosity of the viscous fluid 48 is adjusted to a suitable value, a backflow of the ink 34 held in the snaky passageway 44 can be reliably prevented.

The viscosity of the viscous fluid 48 is determined on the condition that the ink 34 held in the snaky passageway 44 is reliably supplied to the nozzles 37 according to the capillary phenomenon and the ink 34 held in the snaky passageway 44 does not leak through the equalizing hole 47 even though the cartridge 31 is dropped on a floor from the top of a desk. Generally, the viscosity of the viscous fluid 48 is quantitatively determined according to the negative pressure generated in the nozzles 37, the cross-sectional area of the snaky passageway 44, the length of the snaky passageway 44 and the viscosity of the ink 34. In this embodiment, the viscosity of the viscous fluid 48 is set from 30 CP to 100 CP because of the negative pressure 90 Pa, the cross-sectional area 4 $mm^2$, the length 1056 mm and the viscosity 1.9 CP of the ink 34.

The material of the viscous fluid 48 is, for example, Newtonian fluid such as silicon oil. However, the material is not limited to the Newtonian fluid. That is, it is preferable that the viscous fluid 48 be formed by the non-Newtonian fluid such as grease, oil compound and the like.

Figure 12:
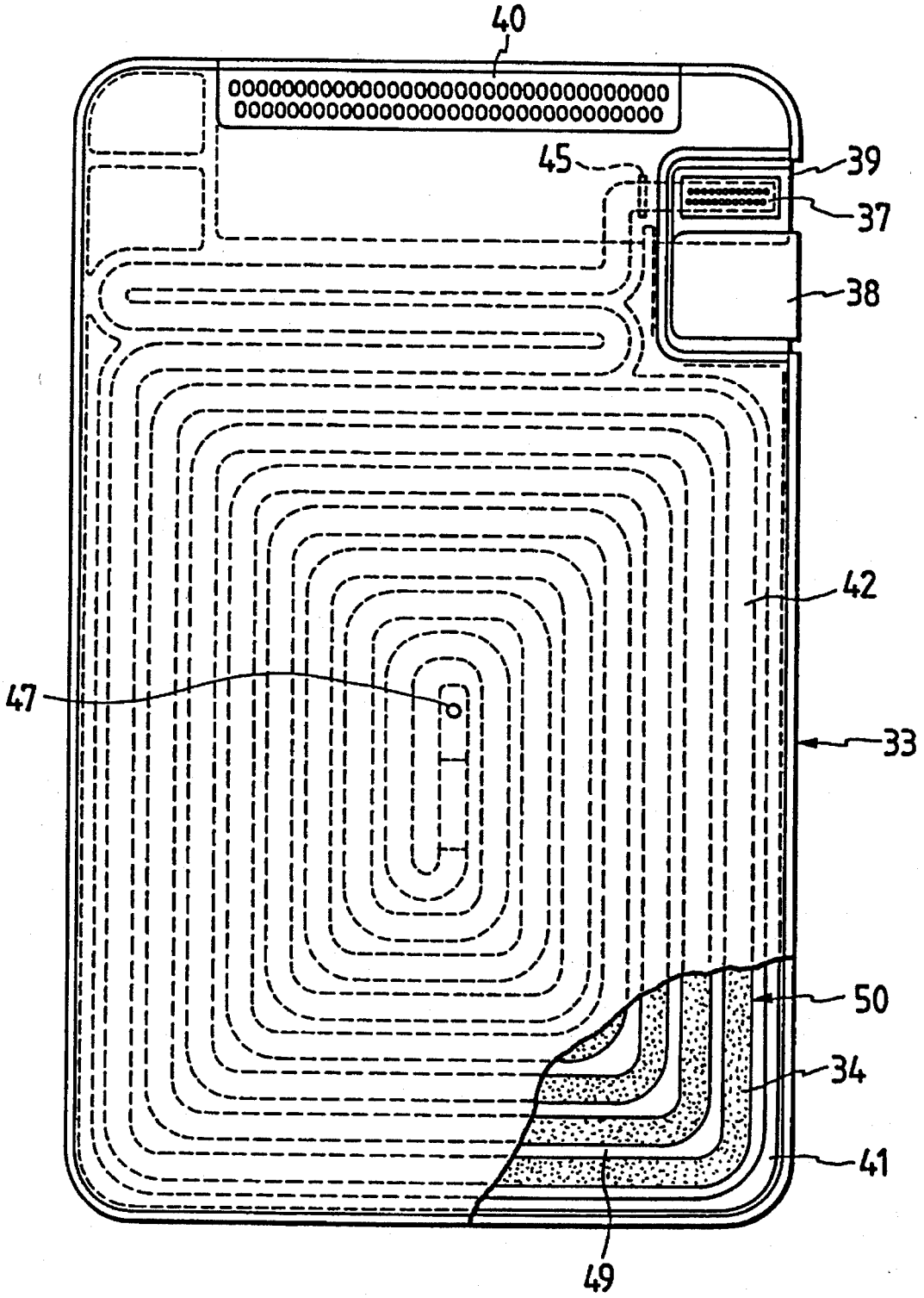
FIG. 12 is a plan view of a thin type ink jet cartridge according to still another embodiment of the present invention.

The opening in the ink holder 41, utilized to hold the ink 34 is not limited to a snake shape such as the snaky passageway 44. That is, as shown in FIG. 12, it is preferable that the opening be formed in a swirl shape on condition that the opening forms a passageway and the cross-sectional area of the passageway is almost constant. In this case, a swirl-shaped reinforcing beam 49 is integrally formed with the ink holder 41 in place of the reinforcing ribs 43. Therefore, the ink 34 held in a swirl passageway 50 surrounded by the reinforcing beam 49 is discharged from the nozzles 37. As for the structural strength of the ink case portion 33 with the swirl passageway 50, the ink case portion 33 is structurally reinforced by the reinforcing beam 49 because the reinforcing beam 49 is arranged over the entire ink holder 41 in the same manner as the ink case portion 33 with the snaky passageway 44.

The reinforcing ribs 43 and the reinforcing beam 49 are not limited to integrally form with the ink holder 41 to form one piece. For example, it is preferable that the reinforcing ribs 43 be separately manufactured from the ink holder 41 and attached on the ink holder 41 with an adhesive agent.

Figure 13:
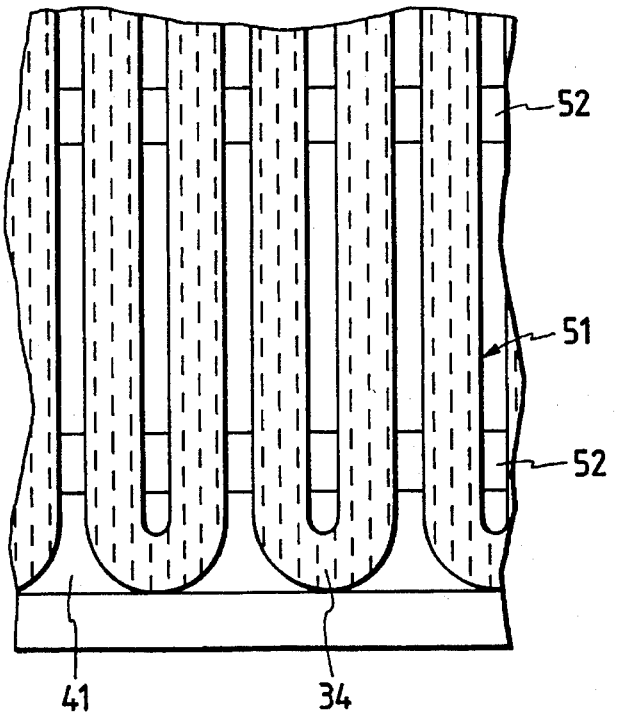
FIG. 13 is a plan view partially showing an ink holder of the cartridge shown in FIG. 12 on an enlarged scale.
Figure 14A:
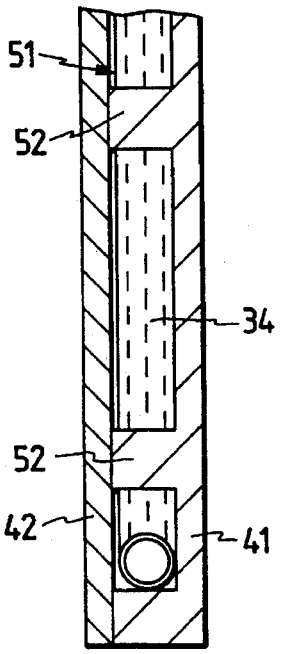
FIG. 14A is a side sectional view taken generally along the lines B—B of FIG. 13.
Figure 14B:
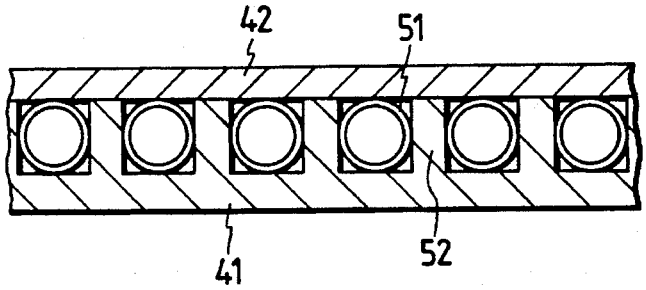
FIG. 14B is a side sectional view taken generally along the lines C—C of FIG. 13.

The snaky passageway 44 and the swirl passageway 50 are not limited to the opening shaped by the reinforcing ribs 43 and the reinforcing beam 49. That is, as shown in FIGS. 13 and 14, it is within the scope of the present invention that each of the passageways 44, 50 is formed by a deformable tube 51 set in the opening formed in the shallow concavity of the ink holder 41. In this case, the deformable tube 51 is bent in a snaky shape to set in the opening. In addition, a large number of reinforcing blocks 52 are arranged at regular intervals on the ink holder 41 in place of the reinforcing ribs 43 or the reinforcing beam 49. The reinforcing blocks 52 are useful in setting the deformable tube 51 in the opening. That is, the deformable tube 51 is fitted between the reinforcing blocks 52 to form a snaky shape. The ink cover 42 is attached on the reinforcing blocks 52 after the deformable tube 51 packed with the ink 34 is set in the opening, while the ink 34 is injected into the snaky passageway 44 or the swirl passageway 50 after the ink cover 42 is attached on the reinforcing ribs 43 or the reinforcing beam 49. Therefore, as for the structural strength of the ink case portion 33 with the deformable tube 51, the ink case portion 33 is structurally reinforced by the reinforcing blocks 52 because the reinforcing blocks 52 are arranged over the entire ink holder 41 in the same manner as the ink case portion 33 with the reinforcing ribs 43.

The material of the deformable tube 51 is polyethylene, fluororesin, vinyl chloride, polypropylene, silicon, and the like. Therefore, the deformable tube 51 is transparent.

When the deformable tube 51 is packed with the ink 34, before the deformable tube 51 is set in the opening of the ink holder 41, bubbles the ink 34 are completely taken out by inclining the deformable tube 51. After the bubbles are taken out from the ink 34 in the deformable tube 51, the tube 51 is sealed with a prescribed sealant before the tube 51 is set in the opening of the ink holder 41.

Therefore, even though the ink jet cartridge 31 with the deformable tube 51 is inclined or shaken when the cartridge 31 is carried, no bubbles are generated in the deformable tube 51. Also, chemical properties of the ink 34 do not deteriorate because the ink 34 held in the deformable tube 51 is sealed from the atmospheric air.

When the cartridge 31 with the deformable tube 51 is set in the carriage 35*c* of the printer 35, the end of the tube 51 opposite to the nozzles 37 is pierced with a needle (not shown) arranged in the carriage 35*c*. Therefore, when the ink 34 held in the deformed tube 51 is discharged from the nozzles 37, the atmospheric air is supplied in the tube 51.

The regular intervals of the reinforcing blocks 52 arranged on the ink holder 41 are determined according to the distribution of the external forces exerted on the thin type of ink jet cartridge 31. Generally, because the external forces are exerted by a user's fingers, the minimum interval of the external forces equals the width of the finger. Therefore, the regular intervals of the reinforcing blocks 52 are set to prescribed values less than the width of the finger.

Accordingly, because the ink 34 held in the deformable tube 51 is sealed from the atmospheric air until the cartridge 31 with the tube 51 is set in the printer 35, the chemical properties of the ink 34 is prevented from deteriorating. In addition, the ink 34 is prevented from being dried and/or being solidified.

Moreover, because the structural strength of the ink case portion 33 is enhanced by the reinforcing blocks 52 arranged over the entire ink holder 41 at the regular intervals, the ink case portion 33 is not deformed by any external enforce even though the ink case portion 33 with the deformable tube 51 is thinned. Therefore, the tube 51 is not deformed by any external forces so that the ink 34 held in the tube 51 is prevented from leaking to the outside.

Moreover, the printing operation can be continued until the ink 34 held in the deformable tube 51 almost becomes empty in the same manner as in the ink jet cartridge 31 with the snaky passageway 44.

Moreover, because the ink holder 41 and the deformable tube 51 are formed by the transparent resin, the reduction of the ink 34 held in the tube 51 can be easily checked.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A thin ink jet cartridge comprising:

ink holding means for holding ink in a thin ink case;

reinforcing means including a swirl-shaped beam for structurally reinforcing the thin ink case of the ink holding means to enhance the structural strength of the thin ink case; and ink discharging means for discharging the ink held in the thin ink case of the ink holding means at a medium of record.

2. A thin ink jet cartridge comprising:

ink holding means for holding ink in a thin ink case;

reinforcing means including a large number of blocks for structurally reinforcing the thin ink case of the ink holding means to enhance the structural strength of the think ink case; and ink discharging means for discharging the ink held in the thin ink case of the ink holding means at a medium of record.

3. A thin ink jet cartridge comprising:

ink holding means for holding ink in a passageway extending in a flat shape;

accommodating means for accommodating the passageway of the ink holding means in a thin ink case to extend the passageway in a deformable tube set arranged in the thin ink case; and ink discharging means for discharging the ink held in the passageway of the ink holding means at a medium of record.

4. A thin ink jet cartridge comprising:

ink holding means for holding ink in a passageway extending in a flat shape;

accommodating means for accommodating the passageway of the ink holding means in a thin ink case; and ink discharging means for discharging the ink held in the passageway of the ink holding means at a medium of record, wherein a viscous fluid is held following the ink in the end of the passageway of the ink holding means opposite to the ink discharging means.

* * * * *